United States Patent [19]

De Santis

[11] 4,025,363

[45] May 24, 1977

[54] SPRAY EQUIPMENT CLEANER

[76] Inventor: Benito De Santis, 2601 W. Olive St., Burbank, Calif. 91505

[22] Filed: Jan. 12, 1976

[21] Appl. No.: 648,278

[52] U.S. Cl. ..... 134/102; 134/103; 134/111; 134/171; 134/200

[51] Int. Cl.[2] ..... B08B 3/02; B08B 9/00

[58] Field of Search ..... 134/102, 103, 166 R, 134/167 R, 171, 200, 201, 111

[56] References Cited

UNITED STATES PATENTS

| | | | |
|---|---|---|---|
| 2,726,667 | 12/1955 | Wigmore | 134/102 |
| 3,601,135 | 8/1971 | Marlow et al. | 134/102 |
| 3,687,731 | 8/1972 | Citrin et al. | 134/171 X |
| 3,771,539 | 11/1973 | De Santis | 134/102 X |

FOREIGN PATENTS OR APPLICATIONS

| | | | |
|---|---|---|---|
| 1,171,225 | 9/1958 | France | 134/102 |

*Primary Examiner*—Robert L. Bleutge

[57] ABSTRACT

A cleaning system for spray equipment, such as paint spray guns and cups, makes use of a stack-up of containers which operate under pressure. Resting on the ground is a tank for cleaning solvent into which air pressure is introduced when needed. Supported above the tank is a spent-fluid collecting receptacle which in turn supports a cleaning cabinet in which a spray gun and cup are suspended for cleaning. All portions of the system are closed during operation except for a vent in the cabinet in which there is a filter for permitting air to escape and which collects and returns dirty solvent to the portion of the cabinet from which it flows through another filter to the collecting receptacle and from there back to the tank. A system of piping has a three way valve capable of directing air above to the cabinet or a mixture of air and cleaning solvent, or shutting off the supply of both air and cleaning solvent.

14 Claims, 10 Drawing Figures

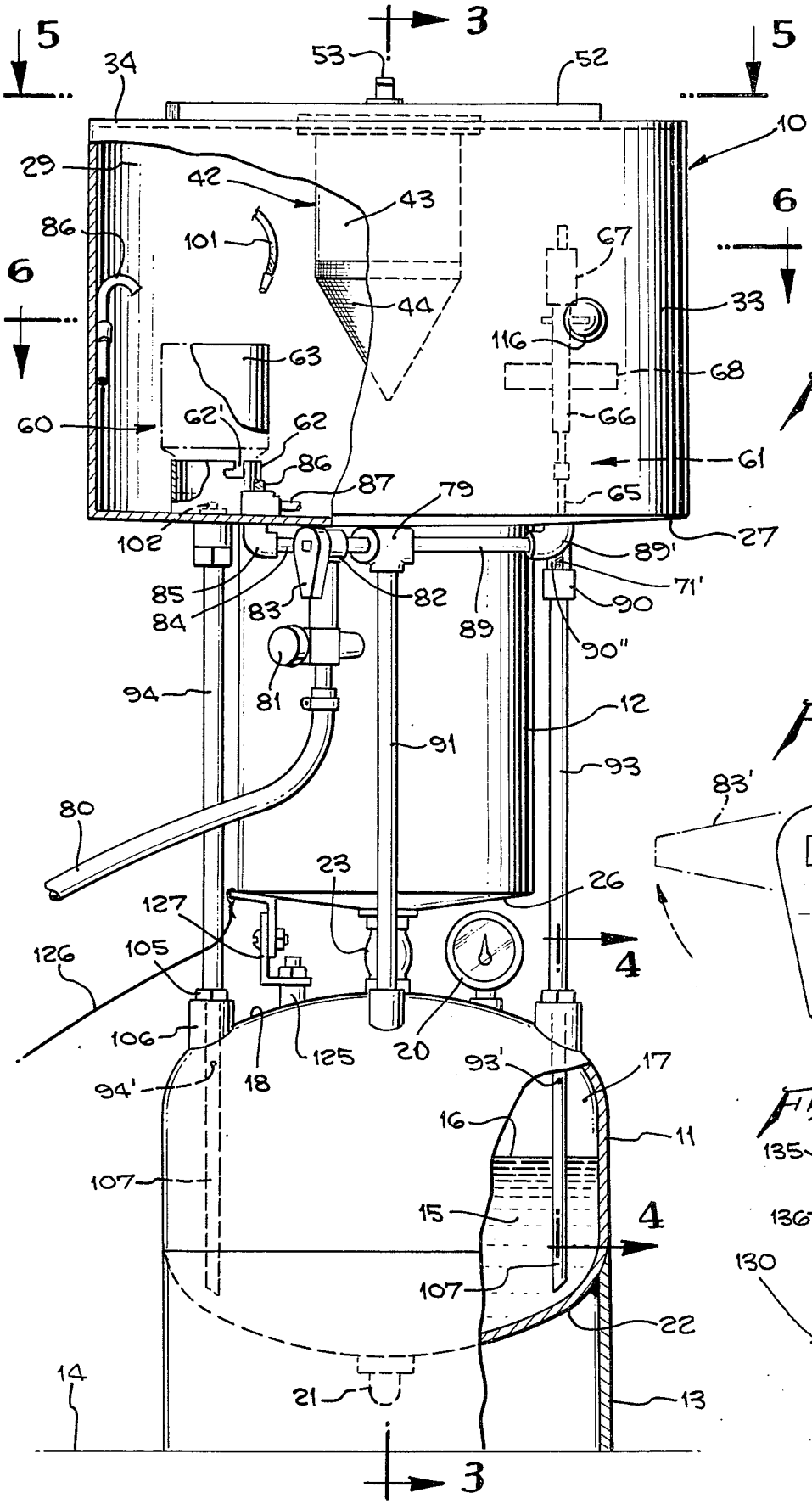
Fig. 1.
Fig. 2.
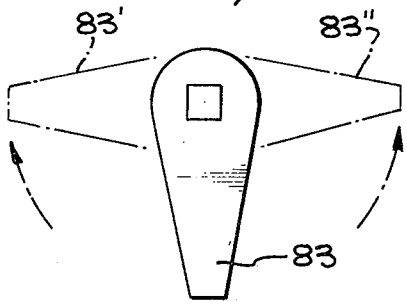
Fig. 10.
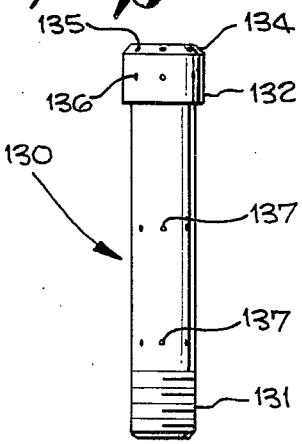

SPRAY EQUIPMENT CLEANER

This is an improvement on U.S. Pat. No. 3,771,539 for Paint Gun Cleaner.

One of the more serious problems in the cleaning of spray equipment, such as the spray guns and cups used for spray painting, is the need to minimize to the greatest degree possible fumes which are generated during the cleaning process. Although such equipment could be confined to a special room, the more effective use of cleaning equipment requires that the cleaning equipment be handy to the job so that the craftsman can very quickly and conveniently clean the spray gun and cup of one paint color so that he can promptly switch to a different color, to be applied to the same job at some other location. For that reason, it is highly desirable to have a small, compact cleaning apparatus close at hand, and also small enough so that it does not occupy an excessive amount of space, and is also sufficiently light and compact permitting it to be readily moved from place to place in the shop.

Inasmuch as such a spray equipment cleaner to be effective needs to operate under some pressure, the creation of fumes cannot be avoided, and when the device is to be kept at a handy location, there must consequently be provided some effective means for keeping the air as clean as possible.

It is therefore among the objects of the invention to provide a new and improved spray equipment cleaner which is small, relatively lightweight, and compact and wherein certain portions of the device serve a double portion, thereby to conserve the amount of structure which may be needed.

Another object of the invention is to provide a new and improved spray equipment cleaner which, although operating under pressure, is capable of filtering out and returning to the process used paint material picked up by the cleaning solvent to the extent that only a relatively small portion of cleaning solvent passes to the atmosphere as a gas.

Another object of the invention is to provide a new and improved spray equipment cleaner possessed of a relatively small, compact cabinet which stands at a convenient working height and which, after being loaded with the equipment to be cleaned, is sealed during the cleaning operation except for a vent for the escape of a small amount of solvent in gaseous form.

Still further among the objects of the invention is to provide a new and improved compact, relatively lightweight spray equipment cleaner, the operation of which is easy and time-saving, which can be set up immediately adjacent the working space and which, once loaded with the equipment to be cleaned, can be operated effectively from the exterior of a sealed cabinet.

With these and other objects in view, the invention consists in the construction, arrangement, and combination of the various parts of the device, whereby the objects contemplated are attained, as hereinafter set forth, pointed out in the appended claims and illustrated in the accompanying drawings.

In the drawings:

FIG. 1 is a vertical sectional view of the spray equipment cleaner set up ready for operation.

FIG. 2 is an elevational view of the valve which controls a part of the operation.

FIG. 10 is a side elevational view of a nozzle for use in cleaning the interior of the cup.

Figure 3:
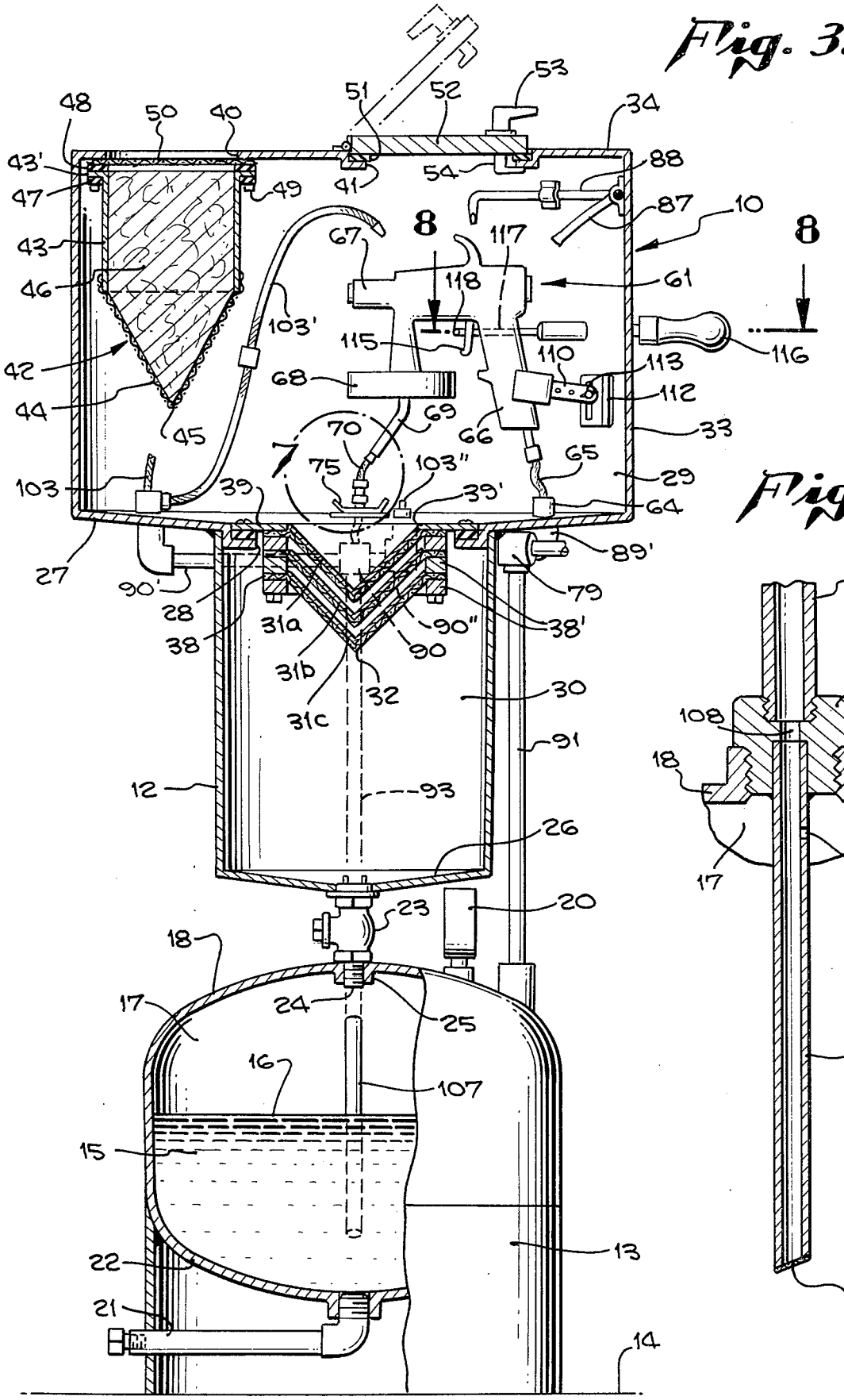
FIG. 3 is a vertical sectional view on the line 3—3 of FIG. 1.

In an embodiment of the invention chosen for the purpose of illustration, a cabinet is indicated by the reference character 10, the cabinet being supported above a tank 11 and carrying a collection receptacle 12 for spent solvent. A footing 13 supports the tank 11 directly upon a supporting surface 14.

The tank 11 provides a hermetically sealed reservoir 15 of cleaning solvent, the level 16 of which will vary from time to time during operation but which, in any event, is low enough to leave a pressure chamber 17 for air under pressure. On a top wall 18 of the tank 11 is a gauge 20. A drain outlet 21 is located at the side of the tank near a dished bottom wall 22.

Also located at the center of the top wall 18 is a downwardly opening check valve 23, from the lower end of which extends a nipple 24 in engagement with an internally threaded flange 25. On the upper side of the fitting 23 is in sealed engagement at the center of a bottom wall 26 of the collection receptacle 12. Spent solvent which accumulates in the collection receptacle 12 upon falling to the bottom wall 26 flows to the center because of the downward pitch of the wall, and then flows through the fitting 23 into the reservoir 15. The top edge of the collection receptacle 12 is welded to a bottom wall inwardly of a side wall 33 of the cabinet 10. An opening 28 in the bottom wall provides for access to a collecting chamber 30 of the collection receptacle.

In the chosen embodiment a series of three conical screens 31$^a$, 31$^b$, and 31$^c$ is provided, each terminating in a lower tip 32. The large end of each screen has a flange 38 anchored between annular rings 38' which are attached to an apertured plate 39 by suitable bolts. The passage 39' in the plate 39 allows solvent to flow from the cleaning chamber 29 through the screens into the collecting chamber 30. Mounted as described the screens can be removed through the opening 28 for cleaning or replacement.

In the top wall 34 is a vent passage 40 and an access opening 41. Suspended from the lower side of the vent passage 40 is a screen or filter indicated generally by reference character 42. The screen has an upper imperforate tubular portion 43 and a lower conical portion 44, the latter terminating in a tip 45. The conical portion, as noted, is made of screen material or filter wire of appropriate sort. Filling the screen air filter 42 is a filter bat which may consist of a filler 46 of floculent material, such for example, steel wool or comparable loose, fibrous synthetic plastic resin. A flange 43' at the upper end of the tubular portion is fastened to the top wall 34 over the vent passage 40 by means of a large annular washer 47 overlying the flange 43' and a gasket 48 and secured by appropriate screws 49. A wire screen or mesh 50 overlies the vent passage 40 and the top of the tubular portion 43.

The access opening 41 is provided with a gasket 51 which accommodates a door 52 provided with a handle 53 and latch 54.

In the cleaning chamber 29 are two stations which in the present embodiment comprise a cup station 60 and a gun station 61. The cup station consists of a sleeve 62 providing a bayonet joint 62' for attachment of a paint cup 63 in upside down position.

Figure 7:
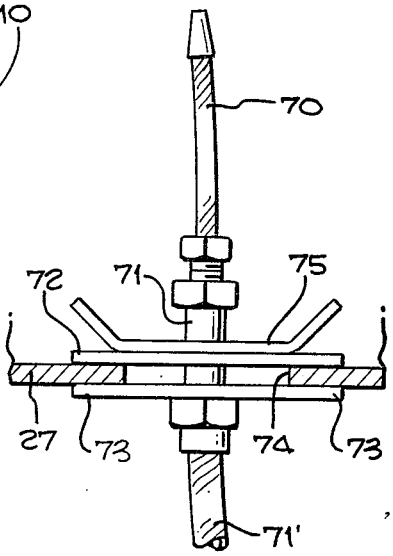
FIG. 7 is a sectional view on the circular line 7 of FIG. 3.
Figure 8:
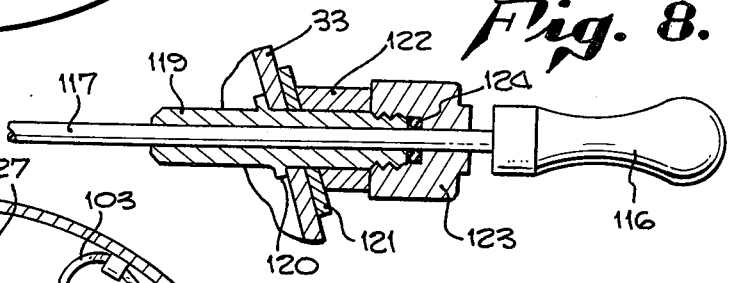
FIG. 8 is a fragmentary cross-sectional view on the line 8—8 of FIG. 3.
Figure 6:
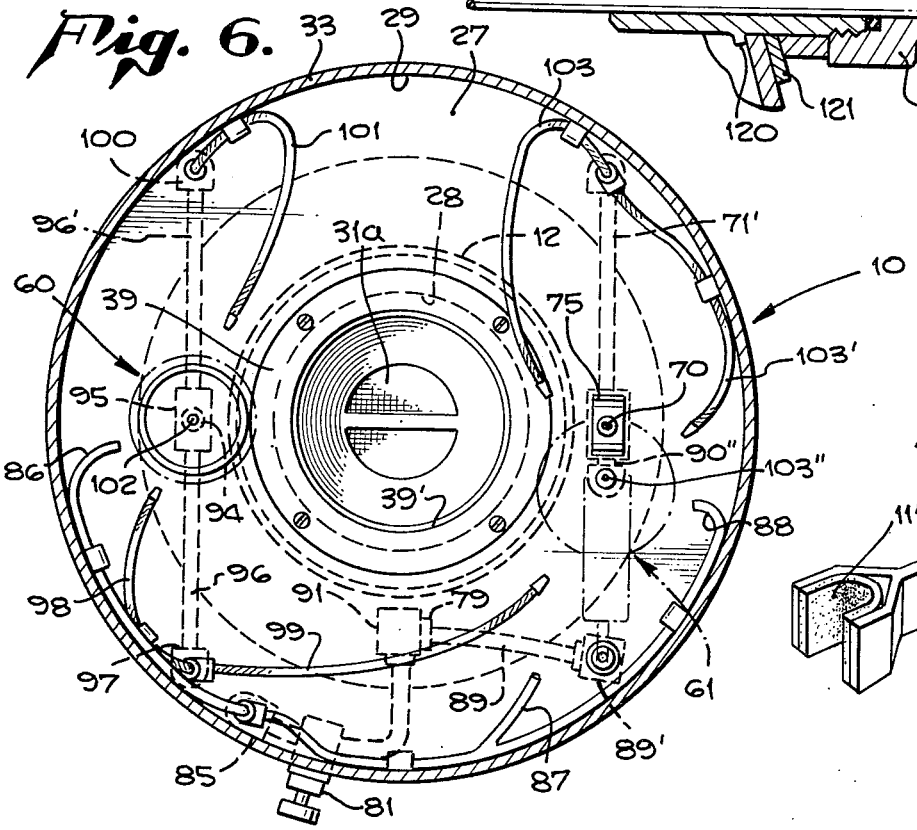
FIG. 6 is a cross-sectional view on the line 6—6 of FIG. 1.
Figure 9:
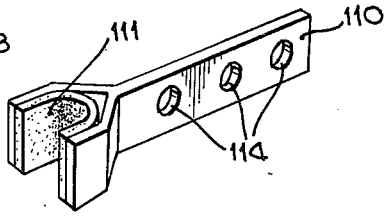
FIG. 9 is a side perspective view of a positioner for the spray paint gun in the cabinet.

The gun station 61 consists in essence of two connections, one comprising an air fitting 64 from which extends a rigid pipe 65 designed to be attached to a handle 66 of a gun 67. Normally this is attachment for compressed air when the gun is being used for spray painting. The gun is provided with a conventional cup receptacle 68 from which extends a stand pipe 69 and the stand pipe in return is connected through a tube 70 to a solvent fitting 71. For flexibility of mounting, the solvent fitting 71 is carried by a pair of washers 72 and 73 which overlie a passage 74 and fit against opposite faces of the bottom wall 27, as shown in FIG. 7. A wing nut 75 is used to tighten the washers in a proper position of adjustment to accommodate the solvent fitting 71.

For supplying compressed air to the operation there is provided an air hose 80. From an appropriate source of air under pressure, the air hose communicates with a pressure regulator 81, downstream of which is a three position valve 82. As shown in FIG. 1, a handle 83 for the three position valve when facing downwardly is set at off position as shown in FIG. 2. When swung to the left in position 83' air only is directed to certain of the outlets. When swung to the right to the position 83'' the major force of air is directed into the solvent tank and air and solvent are passed to the cleaning system.

What this means is that in the air only position 83 air passes from the three position valve to an air line 84 and air fitting 85 to which are connected air spray line 86, 87, and 88 for drying purposes. Air also passes to a fitting 79 and through an air line 89 connected to a two-way air fitting 89' by means of which air only is supplied to the air fitting 64.

An air line 91 is connected from the fitting 79 to the pressure chamber 17 of the tank 11. All three air lines, namely the air lines 84, 89, and 91, receive their supply of air from the three position valve 82. The valve 82, of substantially conventional construction, has a port arrangement such that when the handle is swung toward the right to the position 83'' it supplies air to the line 89 and 91 namely to the gun and to pressure the tank. When swung to the left air is supplied only to the line 84 from which it flows to the lines 86, 87, and 88 for drying the equipment and purging the tank of fumes after washing. When air is applied to pressure the tank solvent is forced upwardly through solvent lines 93 and 94. The solvent line 93, taking solvent from near the bottom of reservoir 15, passes the solvent upwardly to the tube 70. At the same time solvent is picked up from close to the bottom of the reservoir 15 and passed upwardly through the line 94 to the cup station 60. From the three way solvent fitting 95 one branch 96 connected to a fitting 97 supplies flexible solvent lines 98 and 99 directly. A branch solvent line 96' serves a fitting 100 and another flexible solvent line 101. A solvent jet 102 extends inwardly into the interior of the cup 63. There is still aother solvent line 71' which extends from a solvent fitting 90 to the solvent fitting 71. In this way solvent is supplied to the tube 70 and stand pipe 69 which in use would normally be supplied from paint cup 63. From the fitting 90 one branch 90' supplies lines 103 and 103' and another branch 90'' supplies a jet 103''.

Figure 4:
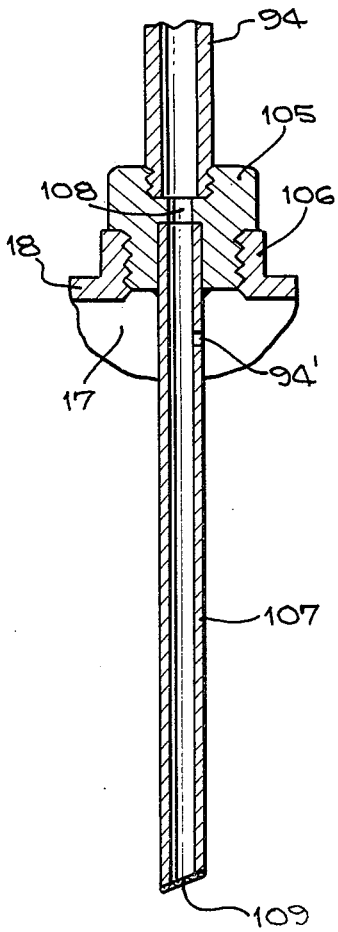
FIG. 4 is a fragmentary vertical sectional view on the line 4—4 of FIG. 1.
Figure 5:
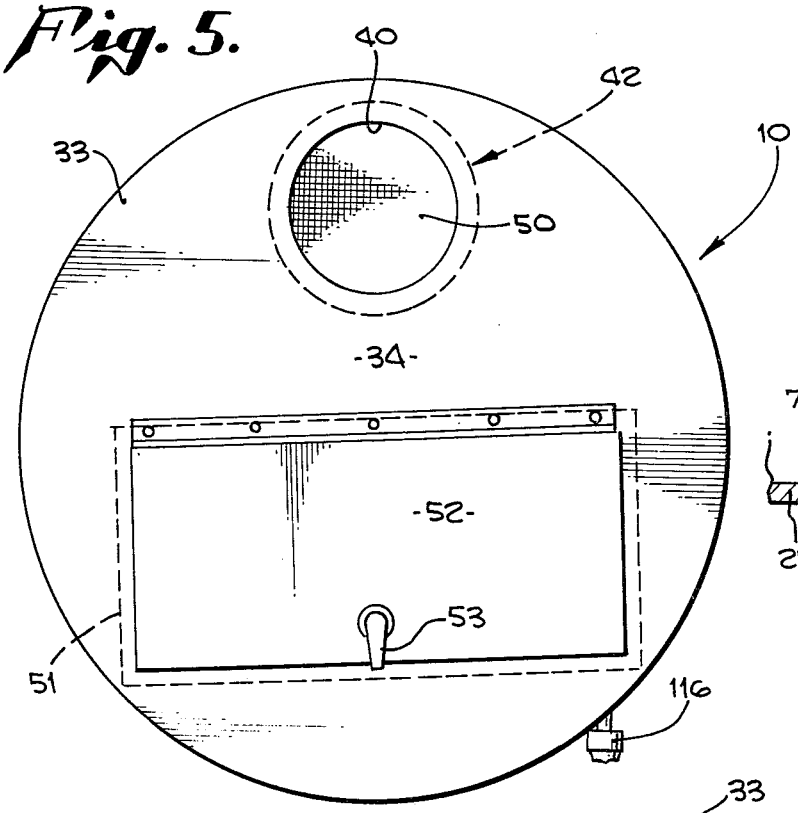
FIG. 5 is a plan view on the line 5—5 of FIG. 1.

A convenient means for attaching the solvent lines 93 and 94 to the tank is shown in FIG. 4, where, for example, the solvent line 94 is shown threaded into a bushing 105 which in turn has a threaded attachment to a flange 106 on the top wall 18 of the tank. A riser 107 has a welded connection to a passage 108 through the bushing 105. At the bottom of the riser is a screen 109. The solvent line 93 is similarly equipped. A small air orifice 94' near the top of the riser 107 in the pressure chamber 17 and a similar small air orifice 93' near the top of the section of solvent line 93 in the pressure chamber may be used to introduce a small amount of air into the solvent for generating turbulence helpful in cleaning.

To provide further rigidity for mounting the gun 67 there is a handle bracket 110 which has a cradle 111 adapted to be pressed into engagement with the handle 66 of the gun 67. A bracket mounting 112 anchored to the side wall of the cabinet is provided with a three position extension 113 to selectively engage one or another of the holes 114 of the handle bracket.

For loading the cabinet with the equipment to be cleaned, the door 52 is lifted to the broken line position of FIG. 3, the cup attached to the cup station 60 and the gun 67 attached to the gun station 61, making the connections already described respectively to the handle 66 and the stand pipe 69. The door 52 is then closed and latched shut. The combination of air and solvent is then supplied by setting the three position valve 82 in right hand position. The cup is immediately sprayed with solvent forced up by air pressure. Solvent under pressure is also supplied to the tube 69. Air is supplied to the gun by manipulating the trigger 115. The trigger is pulled by a handle 116 on the exterior of the cabinet from which a rod 117 extends inwardly terminating in a hook 118 at the location of the trigger 115. Movement of the rod 117 is sealed by employment of a bushing 119 having a flange 120 overlying the inside face of the side wall 33. On the outside face is a washer 121 and sleeve 122 pressed into position by a bonnet 123 within which is an O ring seal 124.

When the trigger is manipulated air passes through the spray nozzle from the pipe 65. Solvent is supplied under pressure to the lines 103, 103' and also the jet 103'' as well as to the lines 98, 99 and 101 and the jet 102, and spread over the exterior and underside parts. The cleaning operation then proceeds until the equipment has been effectively washed off. At this point the three position valve 82 is switched to the left hand position for passing only air through the appropriate air spray lines 86, 87, and 88 for drying off the equipment after the solvent washing bath, and for purging the tank of fumes.

Clearly since a considerable amount of paint is dissolved with the solvent, such a mixture in the absence of the screen filter 42 would be forced into the atmosphere. By reason of the construction and mounting of the screen filter 42 the conical screen portion 44 collects the paint laden solvent with the aid of the filter contents, and by this action the paint laden solvent is trapped by the screen filter and flows down the conical portion 44 to the tip 45 from which it drops to the bottom of the cleaning chamber 29. The paint laden solvent then flows through the opening 39', again being screened by action of the conical screen 31 as it passes into the collecting chamber 30 and then back into the reservoir 15. The solvent continues to be reusable for numerous cleaning operations. When it ultimately becomes overburdened with dissolved paint, used solvent is drawn off through the drain outlet 21 and replaced.

The operation starts with a quantity of solvent in the reservoir which when collected in the collecting chamber 30 has a liquid level below the lower tip of the lowermost screen 31$^c$. When air pressure is applied to the pressure chamber 17 the check valve 23 is forced to close, the solvent being driven into the cleaning chamber 29.

When the cleaning operation is completed air pressure is shut off and the spent solvent first flows through the screens into the collecting chamber 30 and then past the downwardly opening check valve 23 back into the reservoir, ready for the next cleaning operation. Screens can be reached for cleaning through the access opening 41.

A popoff pressure relief valve 125 is provided on the tank 11 and a wire 126 connects the equipment of ground. The valve 125 may double as a support for a bracket 127 and receptacle 12.

From the structure described it will be apparent that extra framing has been dispensed with in that the essential containing elements, namely the tank 11, collection receptacle 12, and cabinet 10, are mounted one upon the other and provide mutual support for each other. Additional stability is provided by making use of rigid pipes for the solvent lines 93 and 94 and the air line 91, providing in this fashion three point stability for the mounting of the cabinet 10 directly upon the tank 11. These rigid pipes serve a double purpose in that the solvent lines 93 and 94 carry solvent upwardly to the operation and the air line 91 carries air downwardly to the operation or more specifically into the tank 11 to put pressure on the reservoir 15. Economy and compactness are in this fashion built into the device adding appreciably to its operability and convenience.

To improve cleaning of the interior of the cup, a nozzle 130 as shown in FIG. 10, may be applied over the jet 102. Threads 131 are for reception in the complementary threaded pocket (not shown) around the jet 102. A cap 132 has a single orifice 133 at the top, and a bevel 134 provided with obliquely directed orificies 135. There are orifices 136 at the sides of the cap and orifices 137 on the sides of the nozzle.

Having described the invention, what is claimed as new in support of Letters Patent is as follows:

1. A compact cleaning device for spray paint equipment including spray guns and paint cups comprising a tank providing a sealed reservoir for cleaning solvent with a pressure chamber for air above the solvent and including a base at a bottom wall of said tank serving as a support for the device, a collecting receptacle having bottom and side wall portions forming a collecting chamber, and a cabinet comprising bottom, top, and side wall portions providing a closed cleaning chamber having therein a spray gun station and a paint cup station, the bottom wall portion of said cabinet being mounted on and substantially supported by the side wall portion of said collcting receptacle, a return pipe interconnecting the bottom wall portion of the receptacle with the top of the tank, said pipe serving as a support for said receptacle and said cabinent on said tank, and a fluid supply system comprising interconnected pipes and a supply line for air under pressure to said system, said system comprising an air supply valve, a first air pipe line from said valve to said reservoir, a first solvent pipe line from said reservoir to said spray gun station and a second solvent pipe line from said reservoir to said cup station and outflow means for solvent from said cabinet to said tank, said outflow means comprising an open passage through said bottom wall portion of the cabinet to said receptacle and having filter means therein.

2. A compact cleaning device as in claim 1 wherein said solvent pipe lines bypass said receptacle and comprise a supporting arrangement between the cabinet and said tank.

3. A compact cleaning device as in claim 1 wherein said solvent pipe lines and said first air pipe line bypass said receptacle and comprise a three point supporting arrangement between the cabinet and said tank.

4. A compact cleaning device as in claim 1 wherein said return pipe includes a check valve which opens in a direction toward said tank.

5. A compact cleaning device as in claim 4 wherein there is a second pipe line to the spray gun station and a third pipe line from said valve to said cup station.

6. A compact cleaning device as in claim 4 wherein there are drying outlets on the respective second and third air lines directed toward respectively the spray gun station and the cup station and wherein said air supply valve is a multiple position valve having a first on position wherein air is passed to said first air pipe line, a second on position wherein air is supplied only to said drying lines and a third position which is off position.

7. A compact cleaning device as in claim 4 wherein there is a cylindrical outlet nozzle at said cup station facing in various directions.

8. A compact cleaning device as in claim 4 wherein said second solvent pipe line has multiple outlets into said cleaning chamber directed at said spray gun station and said paint cup station.

9. A compact cleaning device as in claim 4 wherein said spray gun station comprises a connection to said air pipe line and a connection to said first solvent pipe line, one of said connections comprising a laterally adjustable and releasable sealed mounting on the bottom wall of said cabinet.

10. A compact cleaning device as in claim 4 wherein there is an access opening to said cleaning chamber, a door for said opening, an air outlet in the top wall of said cabinet and a filter screen in said air outlet, said filter screen having a conical bottom of fine screen material mounted with the tip of the conical bottom pointing downwardly.

11. A compact cleaning device as in claim 10 wherein there is a cylindrical portion of said filter screen between the conical bottom and the top wall of said cabinet and a mass of filter material in said cylindrical portion.

12. A compact cleaning device as in claim 4 wherein said filter means comprises a conical screen covering said open passage mounted with the tip directed downwardly.

13. A compact cleaning device as in claim 4 wherein said filter means comprises a plurality of conical screens in vertical spaced alignment with each other and said open passage mounted with tips directed downwardly for the multiple screening of all spent solvent passing from said cabinet.

14. A compact cleaning device as in claim 4 wherein there is an air aspirating orifice in each of the respective solent lines at a location within the pressure chamber for mixing air under pressure with outgoing solvent.

* * * * *